US006461104B1

(12) United States Patent
Shen

(10) Patent No.: US 6,461,104 B1
(45) Date of Patent: Oct. 8, 2002

(54) FLOW REGULATOR FOR A WATER PUMP

(76) Inventor: Der-Fan Shen, 5F, No. 40, Fentzu Wei Chieh, Shan-Chung City, Taipei Hsien (TW)

( * ) Notice: Subject to any disclaimer, the term of this patent is extended or adjusted under 35 U.S.C. 154(b) by 0 days.

(21) Appl. No.: 09/888,136

(22) Filed: Jun. 23, 2001

(51) Int. Cl.[7] ..... F04D 15/00

(52) U.S. Cl. ..... 415/147; 415/156; 415/157; 417/295; 137/501

(58) Field of Search ..... 415/147, 156, 415/157; 251/63.6, 63.5, 62; 137/501, 505, 505.38; 417/295

(56) References Cited

U.S. PATENT DOCUMENTS 3,807,894 A * 4/1974 O'Rourke ..... 137/513
4,021,137 A * 5/1977 Zehren ..... 415/147
6,192,925 B1 * 2/2001 Shen ..... 137/505.38
6,273,126 B1 * 8/2001 Shen ..... 137/501
6,309,185 B1 * 10/2001 Shen ..... 417/295

* cited by examiner

*Primary Examiner*—Edward K. Look
*Assistant Examiner*—Ninh Nguyen
(74) *Attorney, Agent, or Firm*—Pro-Techtor International Services

(57) ABSTRACT

A flow regulator for a water pump, comprising a control valve. The control valve is mounted on an inlet pipe of a water pump and has a chamber, housing a flat-shaped control plate, the upper part of which forms a piston plate, vertically gliding in an upper chamber. The upper chamber is connected with an outlet pipe. The control valve is exposed to water pressure in the outlet pipe, with the control plate driven downward by the water pressure, countered by two springs at two lateral sides of the control plate. The control plate thus has a varying vertical position according to the water pressure.

3 Claims, 3 Drawing Sheets

FLOW REGULATOR FOR A WATER PUMP

BACKGROUND OF THE INVENTION

1. Field of the Invention

The present invention relates to a flow regulator for a water pump, particularly to a flow regulator for a water pump that maintains constant water pressure by a pressure driven switch.

2. Description of Related Art

For maintaining constant water pressure as well as ensuring suitable water pressure in modern high-rise buildings and public places, water pumps are often installed at supply pipes. In addition, a pressure control system is employed, having a pressure sensor and a frequency converter to drive a motor.

The motor has a speed varying according to an input frequency. The frequency converter is controlled by the pressure sensor, in turn varying the speed of the motor. If water pressure is low, the motor is driven up to high speed. When the water pressure is close to a maximum value, the motor speed is reduced. When the water pressure exceeds the maximum value, the motor is stopped. Thus, when a large flow of water is demanded, such that a large pressure difference along the supply pipe results, the frequency converter causes the motor to speed up, and the pumped water flow is increased. On the other hand, when just a small flow of water is demanded, such that a small pressure difference along the supply pipe results, the frequency converter causes the motor to slow down, and the pumped water flow is decreased, resulting in a rapid increase of the pressure difference along the supply pipe.

Using a frequency converter to control the motor for maintaining a constant water pressure has the advantage of rapid reaction to changes in demand and of precise control of pressure. Too steep a rise of water pressure after starting the motor and subsequent sudden stopping of the motor is avoided. Rather, smooth running of the motor is ensured, leading to efficient operation and saving of energy.

However, a frequency-regulated pump requires a motor that is controlled by a frequency converter, which is complicated and expensive to purchase and to maintain. Furthermore, the frequency converter generates heat, so a control box for housing thereof needs to be provided with a radiator, still the frequency converter often gets too hot during use and burns out For these reasons, frequency-regulated pumps are normally only installed in large supply systems.

Another type of flow-regulating system has a motor which is turned on and off by a pressure-sensitive switch. The motor operates at fixed speed. Upper and lower thresholds of water pressure are preset for the pressure-sensitive switch. When water pressure at a supply pipe falls below the lower threshold, the pressure-sensitive switch turns on the motor. When, on the other hand, the water pressure has risen above the upper threshold, the pressure-sensitive switch turns off the motor, until, due to increased demand, water pressure falls below the lower threshold, which causes the motor to be switched on again. Furthermore, to attenuate pressure rises and falls, a container is installed at an outlet of the flow-regulating system, using air or an elastic membrane to store water pressure. The container takes in water when the motor is turned on and releases water by pressure of air or the elastic membrane when the motor is turned off. Thus changes of the water pressure are smoothed out, and start-stop intervals of the motor are lengthened.

This type of flow-regulating system has a comparatively simple structure and is therefore less expensive and easier to maintain. However, the motor thereof runs at a fixed speed.

Thus, after turning on the motor, a fixed maximum water flow is generated, independent of the water pressure.

In order to meet peak demand, the generated water flow is required to be sufficiently large. At times of lower demand, the motor, when running, still runs at full speed, so that excess water flow results and the water pressure rises quickly above the threshold, which in turn stops the motor. This leads to short start-stop cycles of the motor.

At the moment of starting the motor, electric power consumption has a peak value, so that starting and stopping the motor in short cycles results in high power consumption, even if demand for water is low. What is more, water supply in excess of demand leads to high counterpressure at the outlet and higher load as well as to increased power consumption.

SUMMARY OF THE INVENTION

It is the main object of the present invention to provide a flow regulator for a water pump which avoids short start-stop cycles of a motor, reducing power consumption.

Another object of the present invention is to provide a flow regulator for a water pump generating water output according to demand, avoiding excess flow of water and resulting waste of energy.

A further object of the present invention is to provide a flow regulator for a water pump which works in conjunction with a mechanical underpressure system, achieving the function of a frequency converter.

The present invention can be more fully understood by reference to the following description and accompanying drawings.

DETAILED DESCRIPTION OF THE PREFERRED EMBODIMENT

Figure 1:
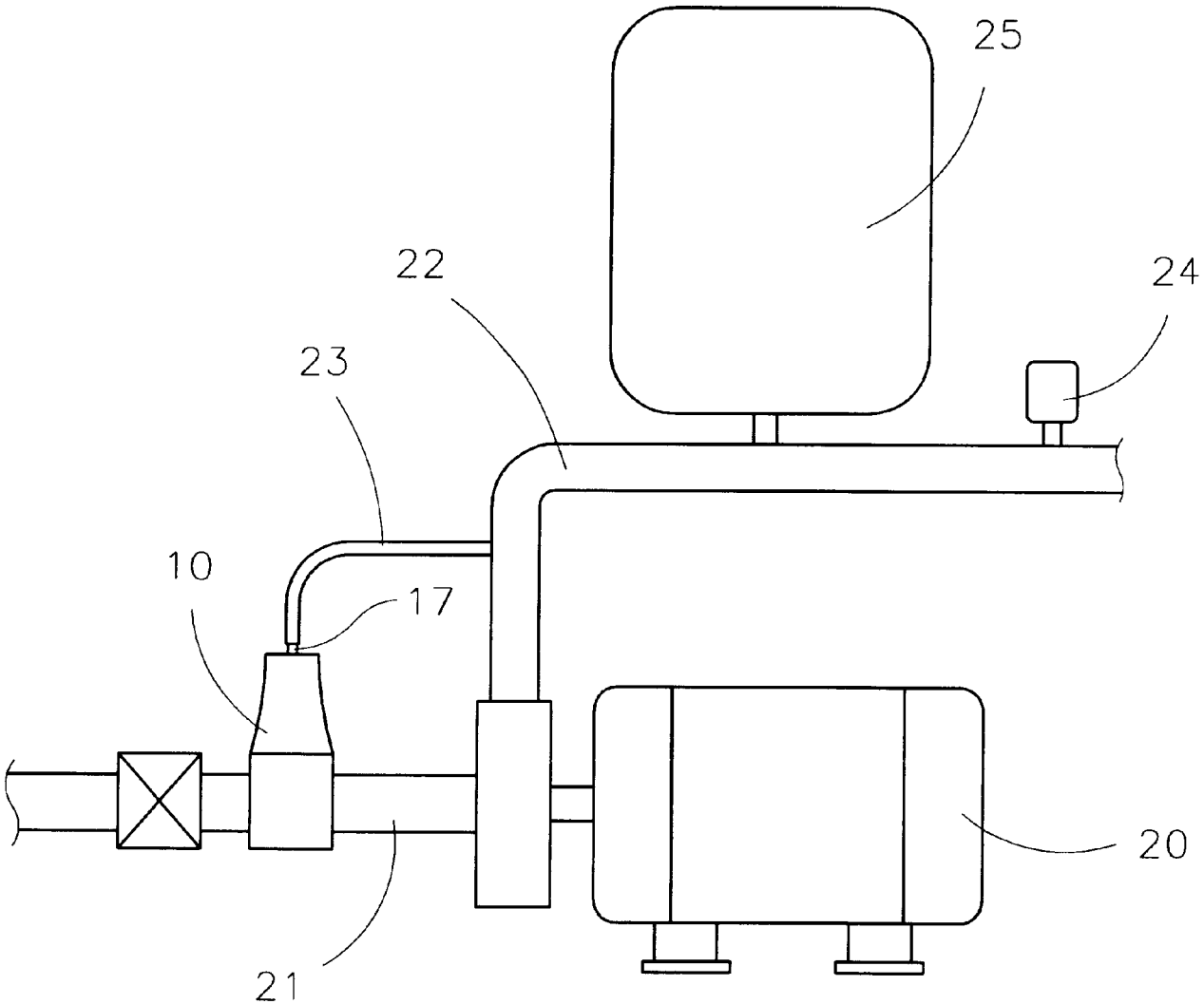
FIG. 1 is a schematic illustration of the flow regulator for a water pump of the present invention in conjunction with a water pump.
Figure 2:
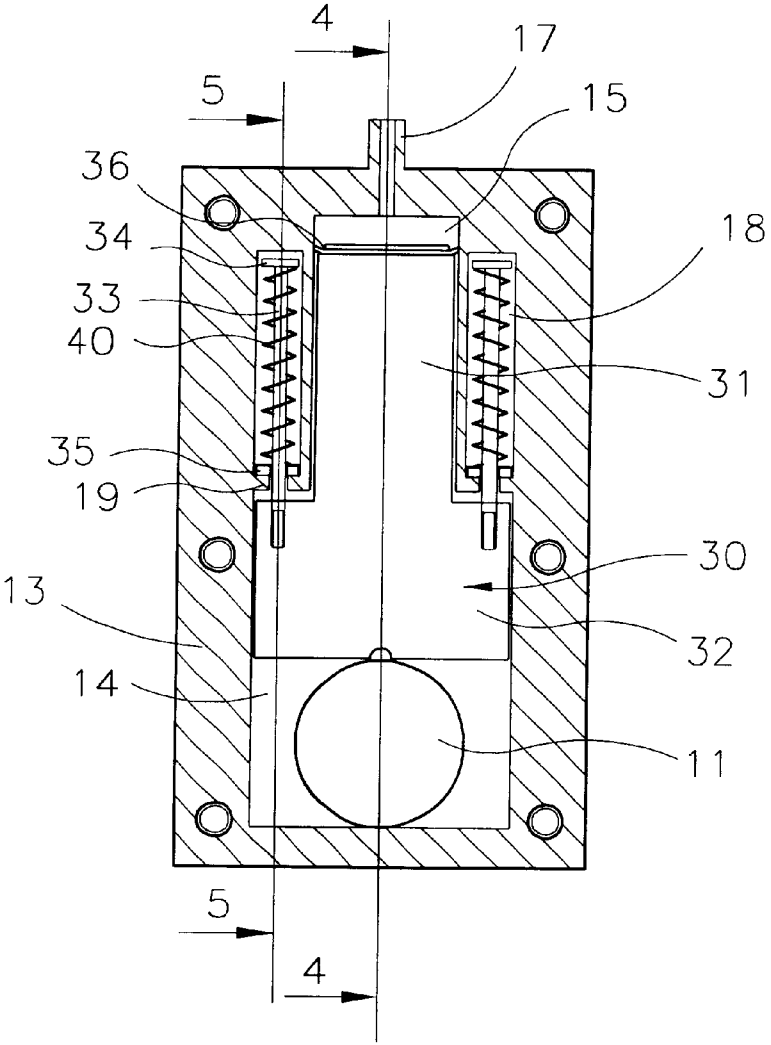
FIG. 2 is a sectional view of the control valve of the present invention.

As shown in FIGS. 1 and 2, the flow regulator for a water pump of the present invention in a first embodiment mainly comprises: a control valve 10, installed at an inlet pipe 21 of a water pump 20 (shown in FIG. 1); a connecting pipe 23, connecting an outlet pipe 22 of the water pump 20 with the control valve 10 for passing water pressure at the outlet pipe 22 to the control valve 10; a pressure-sensitive switch 24, installed at the outlet pipe 22, sensing water pressure therein and controlling turning on and off of the water pump 20; a container 25, connected with the outlet pipe 22 and storing water from there; a control plate 30; and at least one spring 40. The control plate 30 is placed inside the control valve 10 and is driven by the water pressure in the outlet pipe 22, moving accordingly in a vertical direction, regulating water flow through the control valve 10. Thus water flow along the inlet pipe 21 is varied, leading to varying quantities of water through the water pump 20 when demand for water changes (as further explained below).

Figure 3:
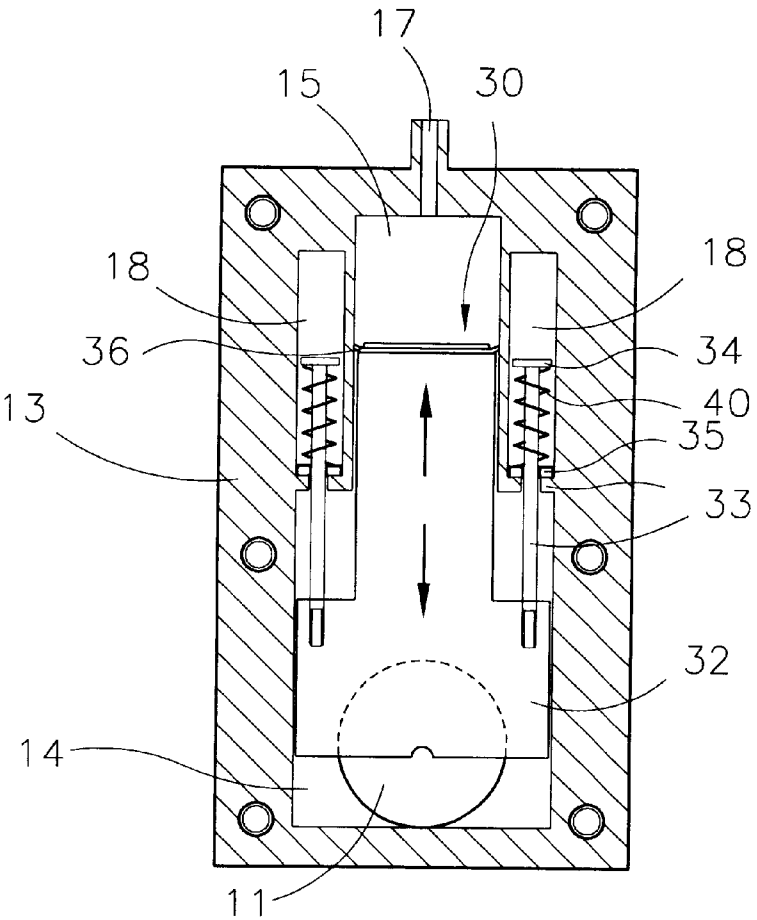
FIG. 3 is a schematic illustration of the control valve disk of the present invention, moving downward under water pressure.

The control valve 10 has a lower part which is passed through by a water flow path 11. The control plate 30 glides within the control valve 10 in the vertical direction, having a lower part that is able to reach onto the water flow path 11. As shown in FIG. 3, when the control plate 30 has lowered to a lowermost position, inner walls of the water flow path 11 are touched, and the water flow path 11 is closed. The springs 40 are mounted at lateral sides of the control plate 30, pulling the control plate 30 towards an uppermost position, leaving the water flow path 11 completely open.

Referring to FIG. 2, the control plate 30 is a flat plate, having a central upper part which forms a piston plate 31 and a lower part which forms a shutter 32. The shutter 32 has a width that is larger than the width of the water flow path 11. Two bolts 33 for guiding the springs 40 are screwed from above into two sides of the shutter 32, carrying bolt heads 34 on top ends which have larger diameters than the springs 40. The springs 40 are put over the bolts 33, restricted from above by the bolt heads 34 and from below by holding rings 35 that glide on the bolts 33.

Figure 4:
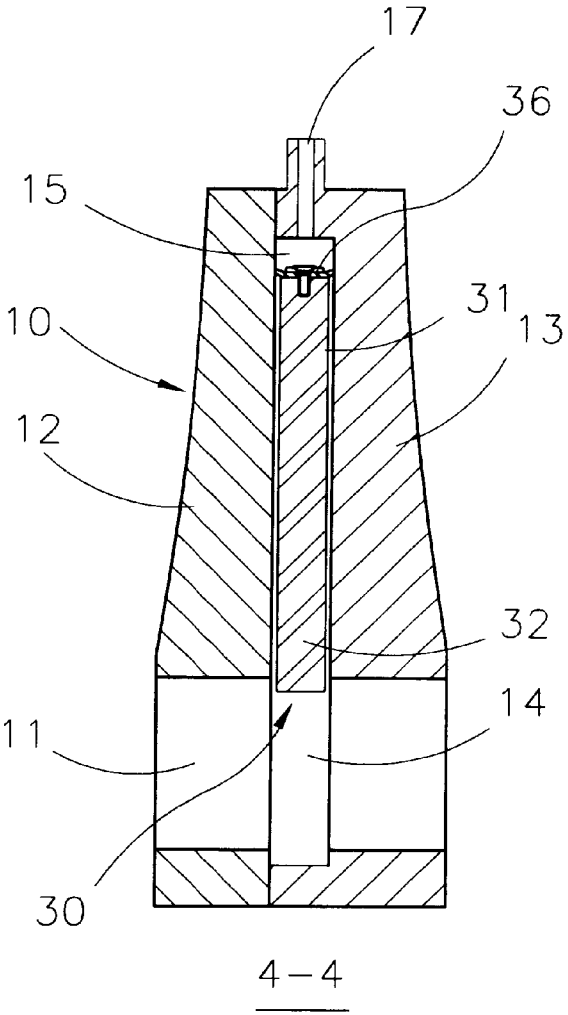
FIG. 4 is a sectional view of the control valve of the present invention taken along line 4—4 in FIG. 2.

As shown in FIGS. 2 and 4, the control valve 10 is formed by two blocks 12, 13 which are screwed together. As shown in FIGS. 2 and 3, the block 13 has an open chamber 14 for housing the shutter 32 of the control plate 30. The open chamber 14 further above has an upper chamber 15, formed like the piston plate 31, accommodating the piston plate 31. A sealing element 36 is fastened to the top side of the piston plate 31. The sealing element 36 has a rectangular shape and is made of a soft material, forming a tight connection with a wall of the upper chamber 15. A water entrance 17 is cut into the top side of the control valve 10. The water entrance 17 is via the connecting pipe 23 connected with the outlet pipe 22, as shown in FIG. 1, so that water pressure from there is transmitted into the upper chamber 15. Water pressure then drives the piston plate 31 downward.

Figure 5:
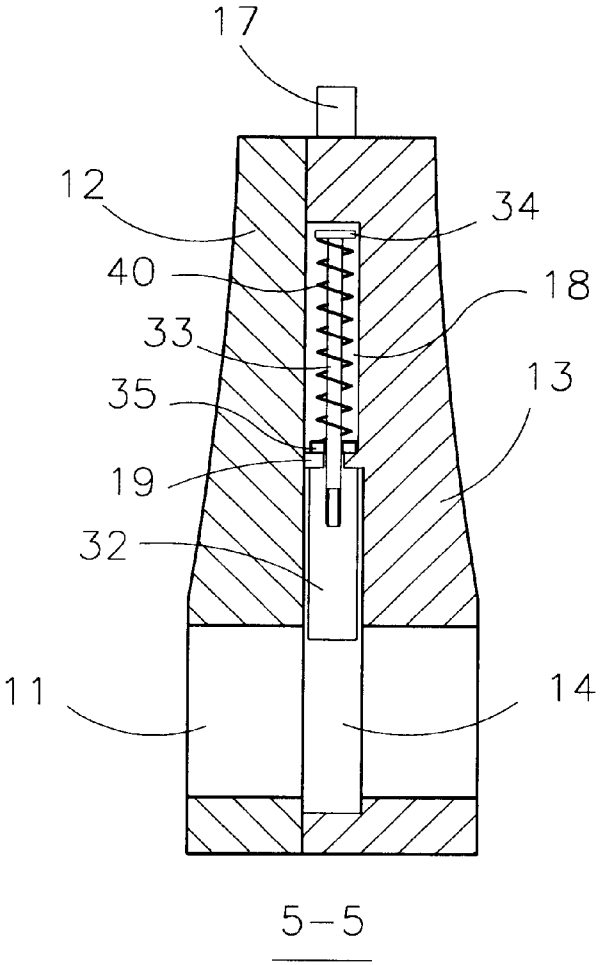
FIG. 5 is a sectional view of the control valve of the present invention taken along line 5—5 in FIG. 2.

Furthermore, as shown in FIGS. 2 and 5, the block 13 has two lateral spaces 18 for accommodating the springs 40 and the bolts 33. The lateral spaces 18 have lengths and widths that are slightly larger than the lengths and widths of the springs 40 and the bolts 33. The lateral spaces 18 have lower ends at which blocking elements 19 are mounted. The blocking elements 19 block the holding rings 35 and thus the lower ends of the springs 40 from gliding upon downward pressure. When the control plate 30 glides downward, the springs 40 are compressed.

Referring again to FIG. 3, the control plate 30 is exposed to water pressure from the outlet pipe 22, moving downward thereupon. At the same time, the springs 40 are compressed, exerting an upward oriented force on the control plate 30. Water pressure needs to overcome the force of the springs 40 to drive the control plate 30 downward. The larger the water pressure, the more the control plate 30 is displaced downward. On the other hand, decreasing water pressure leads to the springs 40 pushing the control plate 30 upward.

According to the balance of water pressure transmitted from the outlet pipe 22 and the force of the springs 40, the control plate 30 has a vertical position that varies with varying water pressure. Any change of the vertical position of the control plate 30 in turn changes the degree of covering of the shutter 32 and thus the water flow through the water flow path 11.

When water pressure in a supply pipe increases, the control plate 30 is driven downward, consequently water flow through the water flow path 11 decreases. When water pressure in the outlet pipe 22 decreases, the control plate 30 is pushed upward by the force of the springs 40, the water flow path 11 opens farther, and water flow is increased.

With low demand for water, water flow through the water pump 20 is larger than needed, and water pressure in the outlet pipe 22 increases. Then the control plate 30 moves downward, so that water flow through the inlet pipe 21 and accordingly through the water pump 20 decreases. Contrarily, upon high demand for water, water pressure in the outlet pipe 22 decreases. Then the control plate 30 moves upward, so that water flow through the water flow path 11, the inlet pipe 21 and accordingly through the water pump 20 increases.

The control valve 10 allows the pump 20 to stay switched on, while water flow follows demand for water. With low demand for water, water flow through the pump is low. Thus a rapid buildup of water pressure after turning on the water pump 20 is avoided. The water pump 20 is turned on for longer time intervals, and short start-stop cycles are avoided, achieving the object of saving energy. Furthermore, with low demand for water, the flow of water through the pump decreases, resulting in less load and lower power consumption.

While the invention has been described with reference to a preferred embodiment thereof, it is to be understood that modifications or variations may be easily made without departing from the spirit of this invention which is defined by the appended claims.

What is claimed is:

1. A flow regulator for a water pump, comprising a control valve, mounted on an inlet pipe of a water pump, said control valve further comprising:

a water flow path passed through by water through said inlet pipe;

a control plate inside said control valve, movable in upward and downward directions, having a shutter with a flat shape and an upper part that forms a piston plate, in a lowermost position almost closing said water flow path, and in an uppermost position completely opening said water flow path;

a chamber inside said control valve, allowing said shutter to glide therein, and having an upper chamber, accommodating said piston plate;

two springs, guided by two bolts which are mounted on two lateral sides of said control plate;

two lateral spaces next to two lateral sides of said chamber, accommodating said two springs and said two bolts, with said two springs being restricted from above by said two bolts and from below by lower sides of said lateral spaces; and a water entrance, cut through a top side of said control valve, connecting said upper chamber and a connecting pipe which leads to an outlet pipe of said water pump, so that water pressure in said outlet pipe is transmitted to said upper chamber;

wherein water pressure from said outlet pipe drives said control plate to move, countered by a force of said springs, resulting in a varying vertical position of said control plate, a varying opening degree of said water flow path and consequently in a varying flow of water through said water flow path.

2. A flow regulator for a water pump according to claim 1, wherein said piston plate has a top side carrying a sealing element for a sealed connection with an inner wall of said upper chamber.

3. A flow regulator for a water pump according to claim 1, wherein said shutter of said control plate has a lower part with a hole, allowing a minimum flow of water when said water flow path is closed.

* * * * *